US008511934B1

(12) United States Patent
Paske

(10) Patent No.: US 8,511,934 B1
(45) Date of Patent: Aug. 20, 2013

(54) DRIVE TRAIN ASSEMBLY FOR A CONCRETE FINISHING MACHINE WITH CENTRALLY LOCATED ENGINE

(75) Inventor: Benjamin J. Paske, Slinger, WI (US)

(73) Assignee: M-B-W Inc., Slinger, WI (US)

( * ) Notice: Subject to any disclaimer, the term of this patent is extended or adjusted under 35 U.S.C. 154(b) by 0 days.

(21) Appl. No.: 13/470,583

(22) Filed: May 14, 2012

(51) Int. Cl.
*E01C 19/22* (2006.01)

(52) U.S. Cl.
USPC ..... 404/112

(58) Field of Classification Search
USPC ..... 404/112
See application file for complete search history.

(56) References Cited

U.S. PATENT DOCUMENTS

| | | | | |
|---|---|---|---|---|
| 3,936,212 | A | 2/1976 | Holz, Sr. et al. | |
| 4,312,603 | A | 1/1982 | Whiteman, Jr. | |
| 4,859,114 | A | 8/1989 | Artzberger | |
| 5,108,220 | A | 4/1992 | Allen et al. | |
| 5,967,696 | A * | 10/1999 | Allen et al. | 404/112 |
| 6,106,193 | A * | 8/2000 | Allen et al. | 404/112 |
| 6,250,844 | B1 * | 6/2001 | Sartler et al. | 404/112 |
| 2002/0041792 | A1 * | 4/2002 | Jaszkowiak | 404/112 |
| 2011/0222966 | A1 * | 9/2011 | Allen et al. | 404/103 |
| 2012/0163914 | A1 * | 6/2012 | Grahl | 404/112 |

* cited by examiner

*Primary Examiner* — Raymond W Addie
(74) *Attorney, Agent, or Firm* — Andrus, Sceales, Starke & Sawall, LLP

(57) ABSTRACT

A drive train assembly for a ride-on twin rotor concrete finishing machine mounts the main clutch and drive belt arrangement at an unobstructed location on a gear box at one end of the supporting frame where it is readily accessible for changing the drive belt without disassembly of the main drive shaft while maintaining a centrally located engine.

6 Claims, 1 Drawing Sheet

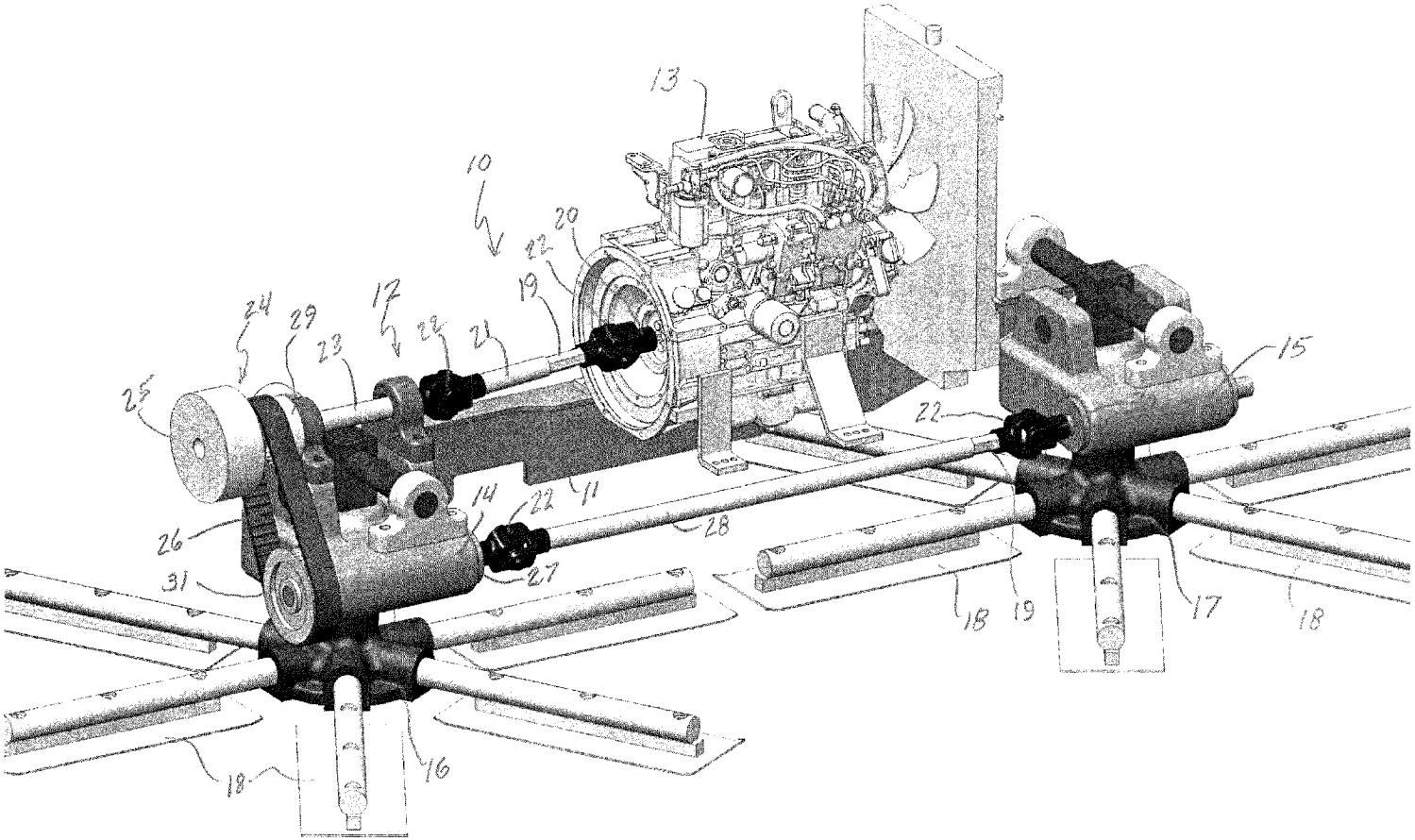
10
11
12
13
14
15
16
17
18
19
20
21
22
23
24
25
26
27
28
29
31

DRIVE TRAIN ASSEMBLY FOR A CONCRETE FINISHING MACHINE WITH CENTRALLY LOCATED ENGINE

BACKGROUND

Powered ride-on concrete finishing machines are well known in the art and typically include a pair of engine-driven rotors each of which carries a plurality of troweling or finishing blades that support the machine and ride over the surface of a poured concrete floor or deck. The rotors and attached blades include a system for applying downward pressure to the blades to tilt the rotors relative to the frame to provide directional control of the finishing machine, all in a manner well known in the art. Ride-on trowels of the foregoing type also utilize a system to vary the pitch of the blades depending on operating conditions. These arrangements are also well developed in the prior art.

Such prior art machines typically have a supporting frame that carries the drive engine, the rotor and the blade assemblies, and an operator's seat and control arrangement, again, all in a manner well known in the art. In one prior art device, the drive engine is mounted directly above one of the rotors via a gear box and is connected to the other rotor with a drive shaft. This offset mounting of the engine results in a machine imbalance and, therefore, is limited to use in smaller trowels that use lightweight engines. As trowel size is increased, higher power heavier engines are needed which cause a machine imbalance. In another prior art arrangement, the drive engine is mounted centrally on the frame between the two rotor assemblies and driving power is transmitted directly from the engine to a drive shaft arrangement below the engine via a clutch and belt arrangement. A particular problem with this type of drive arrangement is that the belt and clutch arrangement is difficult to access because of its central location beneath the engine. Also, in order to replace the drive belt, one of the main drive shafts, carrying the driven pulley and drive belt arrangement, must be disassembled.

SUMMARY

The present invention pertains to a drive train assembly for a twin rotor concrete finishing machine of the type that utilizes a drive engine generally centrally mounted on a support frame between the rotors. The drive train assembly includes a main drive shaft that is connected at one end via a slip-yoke and U-joint directly to the engine output shaft. A first gear box for one of the rotors carries a jack shaft rotatably connected with a U-joint to the other end of the main drive shaft. The first gear box has a drive input from a clutch and drive belt arrangement that is attached to the free end of the jack shaft and drives a driven pulley providing driving power to the first gear box. The first gear box supports and drives the first rotor and the trowel blades carried thereon. The first gear box also has a drive output that is connected by U-joints and a secondary drive shaft directly to a drive input of a second gear box for the other rotor. One end of the secondary drive shaft also includes a slip-yoke. Each of the rotors carries a plurality of finishing blades that receive driving rotation from their respective gear box. The U-joint and slip-yoke arrangements for each of the drive shafts permit movement between the gear boxes and the engine with steering inputs from the operator. The clutch and drive belt arrangement is readily demountable, as for repair or replacement, without disassembly of the main drive shaft.

The drive train assembly includes U-joints that connect each end of the main drive shaft to the respective engine output shaft and the jack shaft, and U-joints that connect each end of the secondary drive shaft to the respective first gear box output and the drive input of the second gear box.

BRIEF DESCRIPTION OF THE DRAWING

The single drive FIGURE is a generally schematic isometric view of the drive train assembly of the present invention with the frame, operator's position and many of the extraneous controls removed for clarity.

DETAILED DESCRIPTION

A concrete finishing machine 10 includes an open structural supporting frame 11 that also carries the entire drive train assembly 12, a drive engine 13, first and second gear boxes 14 and 15, each of which is rotatably connected to a separate rotor 16 and 17 which in turn carries a series of concrete surface-engaging trowel blades 18 that support the machine and ride on the concrete surface being finished. The frame 11 also supports an operator's seat and controls which are not shown, but are typical of prior art constructions.

The engine is mounted at the top of the frame 11 and positioned between the first and second gear boxes 14 and 15. This provides good balance and stability for the finishing machine 10. From the engine 13, the drive train assembly of the present invention receives its driving power from the engine output shaft 20. A main drive shaft 21 is attached to the engine output shaft 20 with a U-joint 22 and slip-yoke 19. A first gear box 14 for the first rotor 16 carries a jack shaft 23 that is rotatably connected to the other end of the main drive shaft 21 with another U-joint 22.

The first gear box 14 receives drive input from a pulley and drive belt arrangement 24 comprising a drive pulley 29 and drive belt 26 connected to the free end of the jack shaft 23. The drive belt is connected to a driven pulley 31 on the gear box 14. The first gear box 14 provides support for and rotatable driving connection to the first rotor 16 and the trowel blades 18 carried thereon.

The first gear box 14 has a drive output 27 connected to one end of a secondary drive shaft 28 via a U-joint 22. The other end of the second drive shaft 28 is connected via another U-joint 22 and slip-yoke 19 to a drive input 30 of the second gear box 15 for the second rotor 17.

By attaching the clutch and drive belt arrangement 24 to the free end of the jack shaft 23, the clutch 25 and/or drive belt 26 are easily removed. The clutch and belt are in a convenient location for ready access and the drive belt 26 can be removed and replaced without disassembly of the drive train 12. As indicated above, prior art two-rotor concrete finishing machines of a construction comparable to that of the subject invention have a drive train connection positioned below the drive engine 13 making it difficult to access and requiring disassembly of a drive shaft connection for replacement of a similar clutch and drive belt arrangement.

What is claimed is:

1. A drive train assembly for a ride-on twin rotor concrete finishing machine having a drive engine generally centrally mounted on a supporting frame between the rotors, the drive train assembly comprising:

a main drive shaft connected at one end to the engine output shaft;

a first gear box for one of the rotors carrying a jack shaft rotatably connected to the other end of the main drive shaft;

the first gear box having a drive input from a clutch and drive belt arrangement attached to the free end of the jack shaft;

the first gear box having a first drive output providing driving connection to the first rotor;

the first gear box having a second drive output connected by a secondary drive shaft directly to a drive input of a second gear box for driving the other rotor;

each of the rotors carrying a plurality of finishing blades receiving driving rotation from their respective gear box; and, whereby the clutch and/or drive belt arrangement is demountable without disassembly of the main drive shaft.

2. The drive train assembly as set forth in claim 1, comprising:

U-joints connecting each end of the main drive shaft to the respective engine output shaft and the jack shaft, and U-joints connecting each end of the secondary drive shaft to each respective first gear box output and the drive input of the second gear box.

3. The drive train assembly as set forth in claim 2, including a slip-yoke connection on the main drive shaft between the U-joints for the main drive shaft, and a slip-yoke connection on the secondary drive shaft between the U-joints for the secondary drive shaft.

4. A drive train assembly for a twin rotor concrete finishing machine having a drive engine generally centrally mounted on a supporting frame between the rotors, the drive train assembly comprising:

a main drive shaft interconnecting the engine output shaft and a jack shaft carried on a first gear box mounted on one end of the frame, the first gear box receiving driving power for one of the rotors from a clutch and drive belt arrangement on a free end of the jack shaft, the other end of which is connected to the main drive shaft for rotation therewith;

the first gear box having a first drive output rotatably connected to the first rotor;

the first gear box having a second drive output connected by a secondary drive shaft to a drive input of a second gear box to provide driving power for the other rotor;

each of the rotors carrying a plurality of concrete finishing blades, each rotor receiving driving rotation from a respective one of the gear boxes; and, whereby the clutch and drive belt arrangement is demountable without disassembling the remaining drive train.

5. The drive train assembly as set forth in claim 4, comprising:

U-joints connecting each end of the main drive shaft to the respective engine output shaft and the jack shaft, and U-joints connecting each end of the secondary drive shaft to each respective first gear box output and the drive input of the second gear box.

6. The drive train assembly as set forth in claim 5, including a slip-yoke connection on the main drive shaft between the U-joints for the main drive shaft, and a slip-yoke connection on the secondary drive shaft between the U-joints for the secondary drive shaft.

* * * * *